US005740749A

United States Patent [19]

Prout

[11] Patent Number: 5,740,749

[45] Date of Patent: Apr. 21, 1998

[54] SEWING MACHINE

[75] Inventor: Jason Prout, Leeds, England

[73] Assignee: AMF Reece, Inc., Richmond, Va.

[21] Appl. No.: 672,224

[22] Filed: Jul. 5, 1996

[30] Foreign Application Priority Data

Jul. 8, 1995 [GB] United Kingdom ..... 9515977

[51] Int. Cl.[6] ..... D05B 21/00

[52] U.S. Cl. ..... 112/470.07; 112/470.09; 112/470.18; 112/148

[58] Field of Search ..... 112/470.07, 470.09, 112/470.14, 470.18, 308, 309, 153, 148, 102, 103

[56] References Cited

U.S. PATENT DOCUMENTS 4,010,701 3/1977 Helfont ..... 112/470.07
4,982,675 1/1991 Taguchi et al. ..... 112/470.07

*Primary Examiner*—Peter Nerbun
*Attorney, Agent, or Firm*—Madson & Metcalf

[57] ABSTRACT

A sewing machine for use with a template capable of holding together two or more layers of fabric that are to be stitched together, the template having a groove shaped according to the required stitching profile and engageable with a guide member projecting upwardly from a baseplate of the sewing machine, the groove being open-ended at its start location and the guide member having a hole through which a needle mounted on the sewing machine passes to effect a stitching action. The machine includes a drive wheel having a periphery capable of engaging a drive edge of the template, means for rotating the drive wheel to effect movement of the template relative to the guide member to drive the template so that the groove moves along the guide member, a probe lying to the feed side of the drive wheel and biased generally towards the guide member, first sensor means operable by movement of the probe against the bias in response to correct initial positioning of the template with the open end of the groove engaged over the guide member, means responsive to the first sensor means to control the drive means so as to move the template into a start position, second sensor means mounted on the sewing machine head and responsive to indicator means on the template to produce a signal sequence from the first sensor means, and control means responsive to the signal sequence to control commencement of stitching and drive of the template from the start position around the desired stitching profile.

6 Claims, 4 Drawing Sheets

SEWING MACHINE

This invention relates to a sewing machine, and particularly to a sewing machine for use with a template capable of holding together two or more layers of fabric that are to be stitched together along a defined stitching profile.

Machines of this type are known, having a guide member that projects upwardly from a baseplate of the sewing machine and engages into a groove formed in the lower surface of the template, the groove being shaped according to the stitching profile. The guide member has a needle passage hole and the machine includes drive means for driving the template relative to the machine so that the groove moves along the guide member. The needle thus stitches along the length of the groove to effect the required connection. The template comprises two or more hinged plates between which fabric layers are placed in the desired relationship, with edges of the layers overlying the groove so that the layers are stitched together along the line of the groove as tile template moves relative to the baseplate.

In templates that have previously been used, the groove is closed both at the start and finish points thereof, and accordingly the template must be lifted in order properly to locate the guide member within the groove. Once so located the drive means is engaged with the template and drive applied to move the template. A known form of drive means comprises a drive wheel, the periphery of which frictionally engages the edge of the template. Initial engagement of the drive wheel with the template causes wear to the template edge and inaccurate movement of the template may result from this wear. The invention seeks to overcome these problems.

A sewing machine including a template capable of holding together two or more layers of fabric that are to be stitched together, and comprising:

- a groove provided in the template and shaped according to a required stitching profile;
- a base plate of the sewing machine having a guide member projecting upwardly therefrom and engageable with said groove, said groove being open-ended at its start location;
- a needle-receiving hole formed in the guide member;
- a needle-mounted on the sewing machine and operative to pass through said hole in the guide member to effect a stitching action;
- a drive wheel having a periphery for engaging a drive edge of the template;
- means for rotating the drive wheel to effect movement of the template relative to the guide member to drive the template so that the groove moves along the guide member;
- a probe lying to the feed side of a drive wheel;
- means Degassing the probe generally towards the guide member;
- first sensor means operable by movement of the probe against the biasing means in response to correct initial positioning of the template with the open end of the groove engaged over the guide member;
- means responsive to the first sensor means to control the drive means so as to move the template into a start position;
- second sensor means mounted on a head of the sewing machine and responsive to indicator means on the template to produce a signal sequence; and
- control means responsive to the signal sequence to control commencement of stitching and drive of the template from the start position around the desired stitching profile.

In operation, the template is moved by hand to engage the open end of the groove over the guide member and to move the probe against the biasing force. The resultant signal causes the drive wheel to move into engagement with the drive edge of the template and to rotate so as to move the template into a start position. The drive edge is engaged ahead of the start position and any wear that is caused is thus in a non-critical region of the drive edge. As the template moves into the start position the indicator means on the template cause operation of the second sensor means, activating the control means to control commencement of stitching and continued drive of the template so that the groove moves over the guide member. No lifting of the template is necessary to achieve proper engagement of the groove with the guide member.

Preferably the machine also includes third sensor means responsive to further indicator means on the template when located correctly transverse to the Line of travel, and the control means is responsive to an additional signal from the third sensor means as well as to the signal sequence from the second sensor means. Use of second and third sensor means allows each to have a coarser response parameter than would be the case if only a second sensor was used.

Preferably the probe comprises a roller mounted on the end of a rod extending in a direction substantially parallel to a line between the needle passage hole and the point of engagement between the drive wheel and the template, spring biasing means are provided for biasing the rod in a direction generally towards the guide member, and the first sensor means comprises a microswitch and means on the rod for operating the microswitch when the rod is moved against the bias by correct positioning of a template against the roller.

The second sensor means is desirably a photoelectric detector, preferably responsive to light reflected from the template although response to light transmitted through one or more openings in the template is possible. The third sensor means may conveniently be a proximity sensor responsive to a section of ferromagnetic material on the template.

In order that the invention may be better understood a specific embodiment of a sewing machine in accordance therewith will now be described in more detail, by way of example only, with reference to the accompanying drawings in which.

Figure 1:
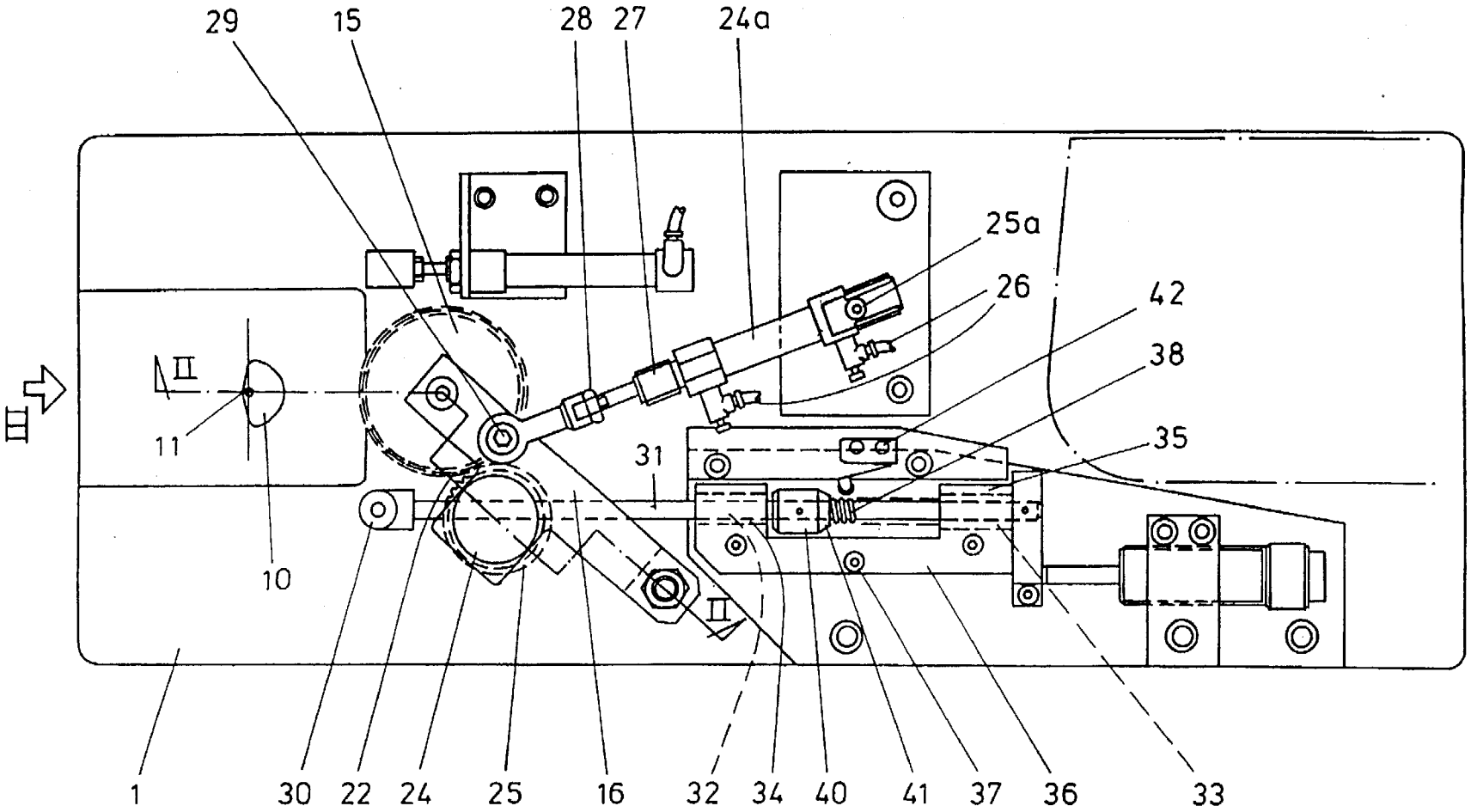
FIG. 1 is a plan view of part of a sewing machine.
Figure 2:
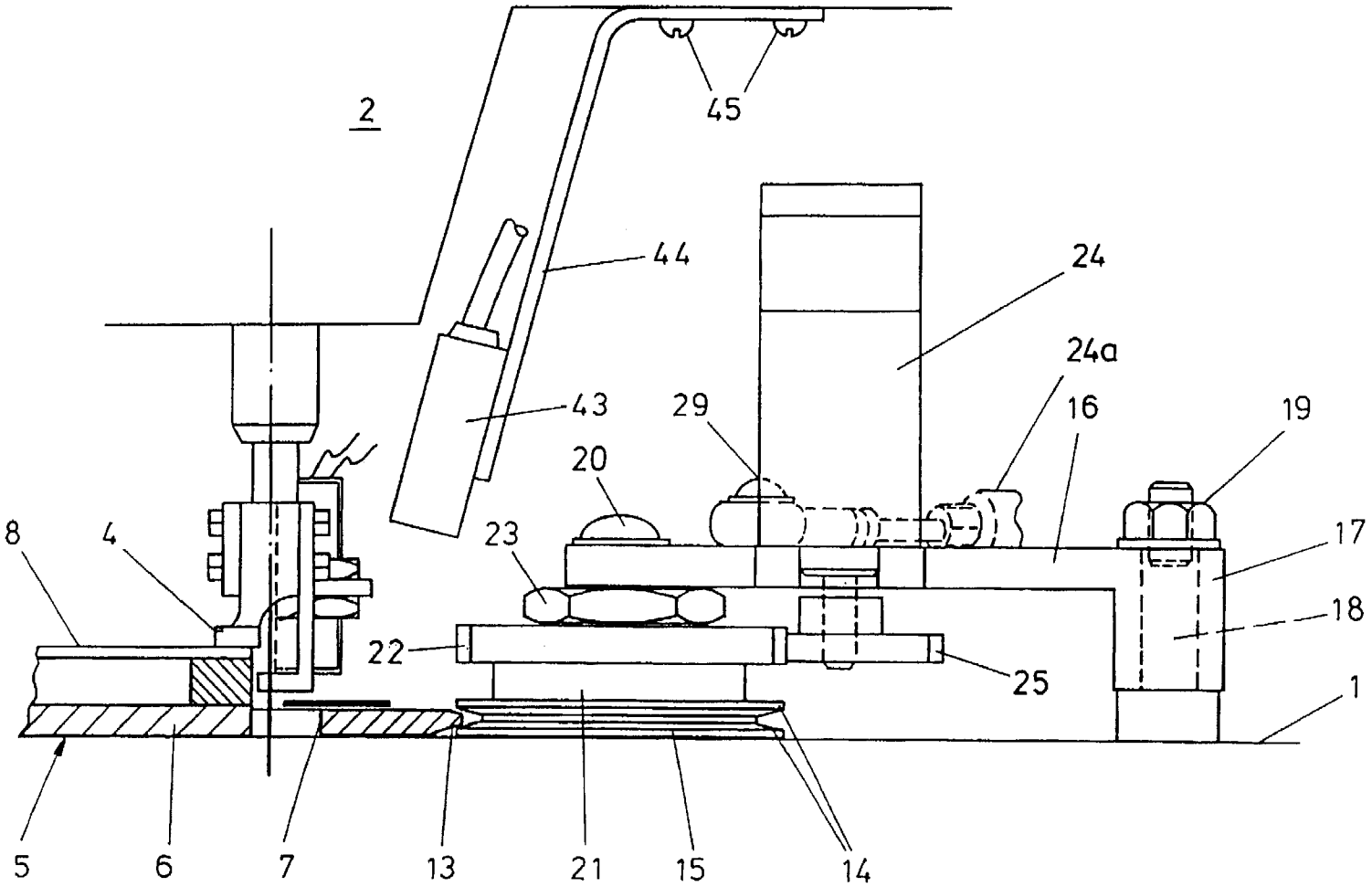
FIG. 2 is a section on the line II—II of FIG. 1.
Figure 3:
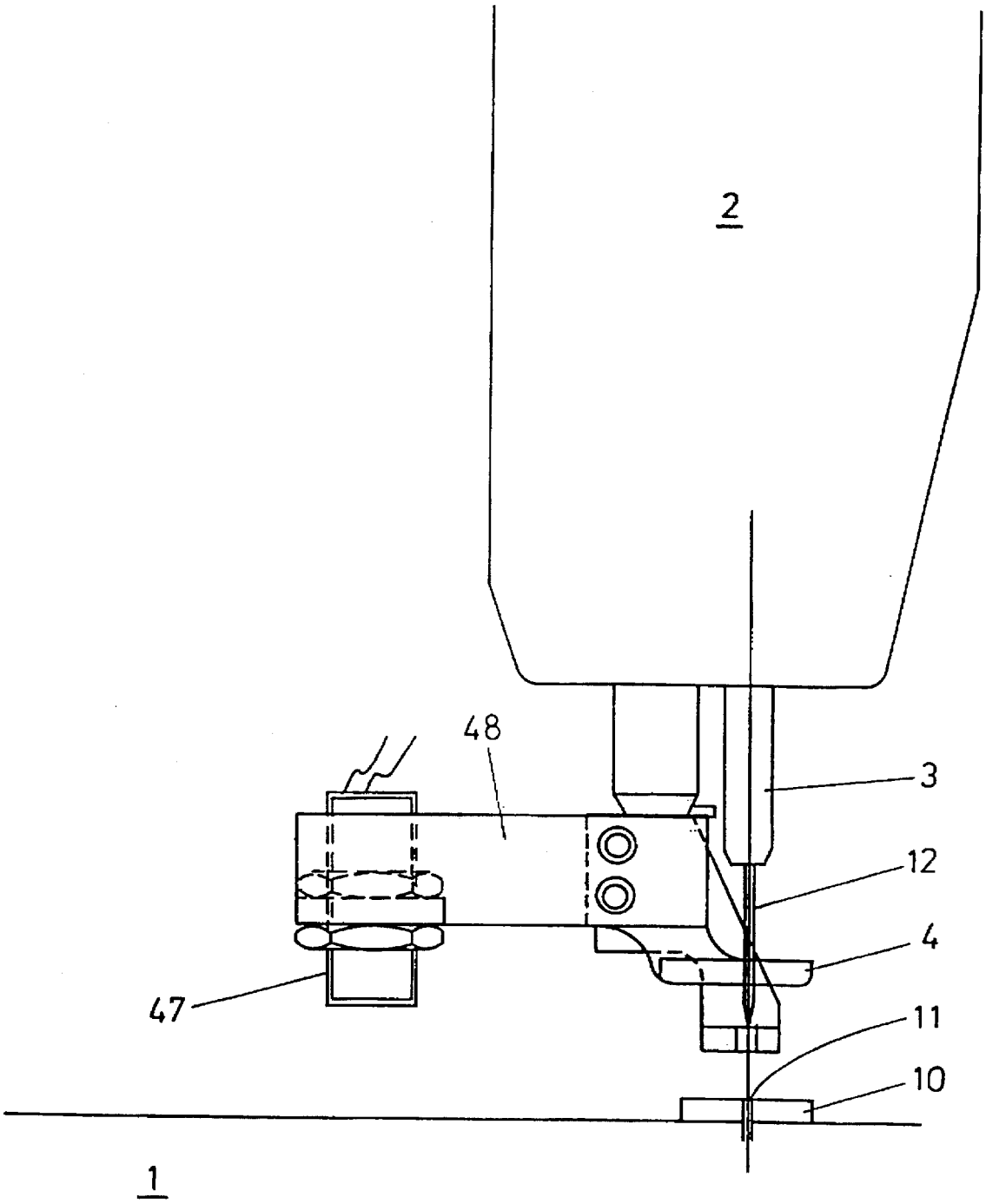
FIG. 3 is an end elevation in the direction of arrow III of FIG. 1.

FIGS. 1 to 3 show part of the upper surface of a baseplate 1 a sewing machine which has a head 2 including a section depending towards the baseplate and enclosing a needle drive mechanism capable of vertically reciprocating a needle holder 3. A presser foot 4 for bearing on the upper surface of a template 5 also extends downwardly from the head 2.

Figure 4:
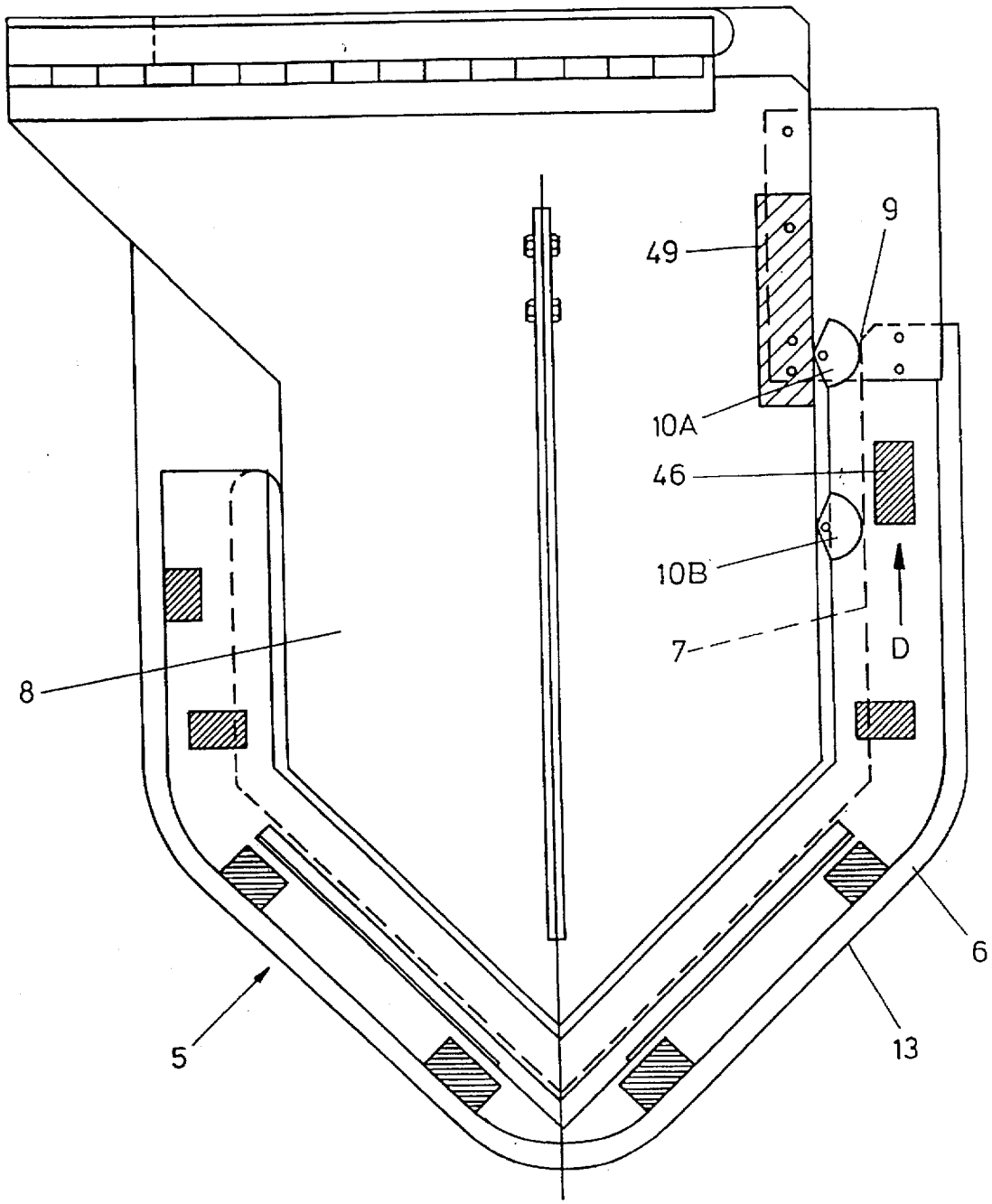
FIG. 4 is a plan view of a template usable with the machine.

The template comprises a lower plate 6, in which is formed a groove 7 shaped according to the required stitching profile, and one or more upper plates such as 8. One or more layers of fabric to be stitched are held between the plates, with edges of the fabric layers overlapping the groove 7. The plates are designed to impart fullness to individual fabric layers as they are loaded into the template, as is well known in this field. The particular template shown in FIG. 4 is suited for the setback tipping of neckties, although the invention is not so limited and is applicable to templates for many other purposes. In each case, however, it is important that the groove 7 is open-ended at its start location 9.

The sewing machine has a guide member 10 projecting upwardly from the baseplate 1, and in use the groove 7 is located over the guide member with the lower surface of the template resting on the baseplate and held in engagement therewith by the presser foot 4. The guide member is formed with a needle passage hole 11 through which a needle 12 mounted on the needle holder 3 may pass during the stitching action.

In order to stitch along the required line the template must be driven relative to the baseplate so that the groove 7 moves over the guide member 10. To this end the edge 13 of the template is shaped so as to be engaged between opposed tapering flanges 14 of a drive wheel 15. The materials are such as to present a high coefficient of friction so that rotation of the drive wheel about its axis will effect longitudinal drive of the template.

A support arm 16 has a transverse boss 17 at one end thereof and is pivotally mounted on the baseplate by engagement of the boss around an upstanding pivot pin 18, having a threaded upper end with which a locknut 19 is engaged. The opposite end of the support arm 16 has a depending bearing pin secured thereto by a screw 20. The bearing pin rotatably supports a sleeve formed integrally with, arid coaxially upstanding from, the drive wheel 15. The sleeve carries a spacer 21 and a pinion 22 secured in position by a locknut 23.

A direct current electric motor 24 is also carried on the support arm 16, and is mounted thereon with its axis parallel to the axis of the drive wheel 15. The output shaft of the motor has a pinion 25 secured thereon, the pinion 25 being in permanent engagement with the pinion 22. Power to the motor is supplied through electrical leads (not shown) and drive control signals are transmitted to the motor through further leads (again not shown), The support arm 16 is biased in the general direction towards the guide member 10 by a pneumatic ram **24*a* having a cylinder pivotally mounted on the baseplate about an axis 25*a* and fed with compressed air through hoses 26. The piston of the ram is connected to a rod 27, provided with a length adjuster 28, the free end of which is pivotally secured to the support arm about an axis 29**.

Situated to the upstream side of the drive wheel 15 (relative to the normal direction of travel of the template) is a roller 30 carried at the end of a rod 31 and forming part of a first sensor means and also a limit member for limiting template movement. The rod passes through spaced guide tubes 32, 33 formed in flanges 34, 35 upstanding from a support 36 secured by bolts 37 to the baseplate. The rod is biased in the general direction of the guide member by a compression spring 38 surrounding the rod between flange 35 and a stop 40 secured to the rod and engageable with the flange 34. The axis of the rod 31 is parallel to the line X—X between the center of the needle passage hole 11 and the point of engagement between the drive wheel and the edge of the template. The stop has a tapered section 41 which can engage the actuator of a microswitch 42 and so close the switch when the rod is moved to the right against the spring bias. The microswitch 42 constitutes another part of the first sensor means.

A photoelectric detector 43 forming a second sensor means is mounted at the end of a carrier 44 secured to the sewing machine head by screws such as 45. The detector is angled towards the region between the guide member 10 and the drive wheel 15 and incorporates a light source and a photocell detecting light reflected from the source by part of a template located in this region. The template itself has an upper surface section of reflective material, and adhered to this surface section is a plurality of pads of non-reflective material. Only the pad 46 is relevant to this particular invention, the remaining pads shown in FIG. 4 being used to provide control signals for later stages of a stitching operation.

A magnetic or inductive proximity sensor 47, forming third sensing means, is secured by a carriage 48 to the presser foot 4. Sensor 47 is directed downwardly towards the template downstream of the presser foot in the direction of travel of the template. The template has a piece of ferromagnetic material 49 secured thereto for activating the sensor 47 when in proximity thereto.

In operation, the template is loaded with the fabric pieces that are to be stitched together, with the edges of the pieces overlying the groove 7. The template is moved manually over the baseplate to present the open end 9 of the groove 7 to the guide member 10 and to engage the groove over the guide member. The guide member is then in the relative position shown as 10A in FIG. 4. In so doing, the edge of the template is engaged with the roller 30 and so moves the rod 31 against the biasing force to close the microswitch 42. Closure of this switch operates valve means (not shown) admitting compressed air to the ram 24 to cause the rod 27 to move support arm 16 about its pivot and so move the drive wheel 15 into engagement with the periphery of the template. The motor 24 is then energized to rotate the drive wheel clockwise and so cause the template to be drawn in the direction of the arrow D to a start position at which the guide member 10 is in the relative position shown at 10B in FIG. 4.

During this initial movement of the template the ferromagnetic material 49 moves beneath the proximity sensor 47 to provide a control signal which enables control of the stitching mechanism. It will be seen that this sensing action only occurs if the template is in proper alignment transversely of the normal direction of travel, i.e. if the groove 7 is correctly engaged over the guide member 10. If this is not the case then the enabling signal is not received and stitching can not commence.

If the enabling signal is received then preliminary drive of the template in the direction D is continued until the non-reflecting part 46 has moved beneath and immediately past the photoelectric detector 43. This movement creates an on/off/on signal sequence from the detector and, if enabled by the signal from the proximity sensor 47, this causes stitching to commence and clockwise rotation of the roller to continue to move the template along the required stitching path. As has already been intimated, other non-reflective sections of the template may be used to control stopping and starting of stitching as required during the movement of the template.

From the foregoing description it will be appreciated that the groove is located over the guide member while the template lies flat on the baseplate, and there is no need to lift the template to effect this engagement. Preliminary engagement of the groove with the guide member and closure of the microswitch 42 causes the template automatically to be drawn into the start position, the second and third sensors providing safeguards which prevent stitching unless and until the template is in required position.

It will be understood that modifications may be made to the apparatus as specifically described. In particular the three sensor means formed by the roller, the photoelectric detector and the proximity sensor may all be replaced by different forms of sensor which will form the equivalent function. Other modifications will be apparent to those skilled in the art.

I claim:

1. A sewing machine including a template capable of holding together two or more layers of fabric that are to be stitched together, and comprising:

a groove provided in the template and shaped according to a required stitching profile;

a base plate of the sewing machine having a guide member projecting upwardly therefrom and engageable with said groove, said groove being open-ended at its start location;

a needle-receiving hole formed in the guide member;

a needle mounted on the sewing machine and operative to pass through said hole in the guide member to effect a stitching action;

a drive wheel having a periphery for engaging a drive edge of the template;

means for rotating the drive wheel to effect movement of the template relative to the guide member to drive the template so that the groove moves along the guide member;

a probe lying to a feed side of the drive wheel;

means biassing the probe generally towards the guide member;

first sensor means operable by movement of the probe against the biassing means in response to correct initial positioning of the template with the open end of the groove engaged over the guide member;

means responsive to the first sensor means to control the drive means so as to move the template into a start position;

second sensor means mounted on a head of the sewing machine and responsive to indicator means on the template to produce a signal sequence; and control means responsive to the signal sequence to control commencement of stitching and drive of the template from the start position around the desired stitching profile.

2. A sewing machine according to claim 1, including further indicator means on the template, and third sensor means responsive to said further indicator means when located correctly transverse to the line of travel, the control means being responsive to an additional signal from said third sensor means as well as to the signal sequence from the second sensor means.

3. A sewing machine according to claim 2, in which the third sensor means is a proximity sensor, and including a section of ferro magnetic material on the template to which said proximity sensor is responsive.

4. A sewing machine according to claim 1, in which said probe comprises a rod having a roller mounted on one end and with the rod extending in a direction substantially parallel to a line between the needle hole and the point of engagement between the drive wheel arid the template, and including spring biassing means for biassing the rod in a direction generally towards the guide member, and a micro-switch provided by said first sensor means and means on the rod for operating the micro-switch when the rod is moved against the spring biassing by correct positioning of a template against said roller.

5. A sewing machine according to claim 1, in which the second sensor means is a photo-electric detector.

6. A sewing machine according to claim 5, in which the photo-electric detector is responsive to light reflected from the template.

* * * * *